United States Patent [19]

Marchaj

[11] 4,267,676

[45] May 19, 1981

[54] EARTHQUAKE RESISTING TANK AND METHODS OF CONSTRUCTING SAME

[75] Inventor: Tadeusz J. Marchaj, Pt. Washington, Long Island, N.Y.

[73] Assignee: Preload Technology, Inc., Garden City, N.Y.

[21] Appl. No.: 15,102

[22] Filed: Feb. 26, 1979

[51] Int. Cl.[3] ..... E04H 9/02; E04B 1/98; E02D 27/34

[52] U.S. Cl. ..... 52/167; 52/224; 220/1 B; 220/71

[58] Field of Search ..... 52/167, 224, 248, 245, 52/247; 220/1 B, 71

[56] References Cited

U.S. PATENT DOCUMENTS

| | | | |
|---|---|---|---|
| Re. 29,777 | 9/1978 | Crowley | 52/224 |
| 845,046 | 2/1907 | Bechtold | 52/167 |
| 1,138,394 | 5/1915 | Mueser | 220/1 B X |
| 3,217,451 | 11/1965 | Closner | 52/224 |
| 3,241,278 | 3/1966 | Magers, Jr. | 52/224 |
| 3,377,757 | 4/1968 | Magers, Jr. | 52/224 |
| 3,510,999 | 5/1970 | Hubacher et al. | 52/167 |
| 3,696,573 | 10/1972 | Zerna | 52/224 |
| 3,880,315 | 4/1975 | Nelson et al. | 220/1 B X |
| 3,990,600 | 11/1976 | Rossitto et al. | 220/1 B |
| 4,126,976 | 11/1978 | Crowley | 52/224 |

FOREIGN PATENT DOCUMENTS

| | | | |
|---|---|---|---|
| 541280 | 11/1941 | United Kingdom | 52/245 |

*Primary Examiner*—Alfred C. Perham
*Attorney, Agent, or Firm*—Curtis, Morris & Safford

[57] ABSTRACT

This application relates to a tank for the storage of liquids, and more specifically to a tank adapted to withstand earthquake conditions and to methods for constructing same. More specifically, this application relates to a cylindrical tank having a side wall which is banded by one or a plurality of reinforcing means at the location at which the tank wall would be subject to maximum combined stresses resulting from gravitational, horizontal and vertical accelerations under an earthquake load. The application also relates to a tank having a side wall which is tapered from a maximum thickness at its base to a minimum thickness at its top and which is surrounded by one or a plurality of reinforcing means to counteract bulging and/or failure under earthquake loads.

42 Claims, 10 Drawing Figures

EARTHQUAKE RESISTING TANK AND METHODS OF CONSTRUCTING SAME

This application relates to a tank for the storage of liquids, and more specifically to a tank adapted to withstand earthquake conditions and to methods for constructing same. More specifically, this application relates to a cylindrical tank having a side wall which is banded by one or a plurality of reinforcing means at the location at which the tank wall would be subject to maximum combined stresses resulting from gravitational, horizontal and vertical accelerations under an earthquake load. The application also relates to a tank having a side wall which is tapered from a maximum thickness at its base to a minimum thickness at its top and which is surrounded by one or a plurality of reinforcing means to counteract bulging and/or failure under earthquake loads.

The problem of designing a tank which is capable of withstanding an earthquake load has long confronted the art. More particularly, the problem of designing a liquid-containing tank the side wall of which is resistant to bulging and failure under earthquake conditions had not been solved. Prior reinforcement measures have either been insufficient to withstand the extraordinary forces encountered during earthquakes or prohibitively expensive.

Seismic design techniques for liquid-containing tanks, as reflected in the specifications set forth in relevant laws and construction codes, have been based on the assumption that, in a rigid liquid container, horizontal accelerations of the earth generate dynamic forces acting outwardly on one side of the tank and inwardly on the opposite side. A further assumption has been that the horizontal acceleration of the tank is the same as that of the ground. Accordingly, the conventional technique has been to counter only forces on the wall created by the exertion of horizontally-directed forces on the tank. These forces include: (1) a force which is directly proportional to the maximum horizontal acceleration of the ground and which is exerted on the wall by the mass of a lower portion of fluid in the tank and by the mass of the tank itself; and (2) a convective force exerted by an upper portion of the liquid which oscillates in response to the horizontal acceleration of the ground. The above-mentioned forces and their locations and directions are calculated as described in Thomas et al., *Nuclear Reactors and Earthquakes,* TID-7024, National Technical Information Service, U.S. Dept. of Commerce. This source has been used for several years as a standard upon which to base the designs of earthquake-resistant tanks.

The above-mentioned forces tend to move the tank horizontally. They act on the tank at some distance above its bottom, thereby creating both a horizontal shear force at a section above the bottom of the tank and an overturning moment. The overturning moment manifests itself in vertically-oriented stresses in the tank wall; that is, compressive stresses develop in the side of the tank wall that resists outwardly acting forces and tensile stresses develop in the wall on the opposite side. A tank adapted to withstand such forces is described in applicant's copending U.S. patent application Ser. No. 906,332, filed May 16, 1978.

Despite countermeasures based on the foregoing design methods, it has been observed that under an earthquake load the side wall of a tank bulges radially (thereby deforming permanently) in the lower part of the tank so as to resemble the foot of an elephant. This phenomenon is aptly referred to as "elephant foot" deformation. It has also been observed that during earthquake conditions, the side wall of a tank has a tendency to fail at or near the location of "elephant foot" deformation under repeated shocks imparted to the tank. Previous seismic design has not been able to eliminate "elephant foot" or failure of the tank wall as described.

While previous seismic design techniques have had as their goal counteracting forces produced solely by the horizontal and gravitational accelerations of the tank and its contents, I have now discovered that only by considering the tank as an elastic body and by counteracting forces due to vertical acceleration of the tank as well as to horizontal and gravitational accelerations can the problem of "elephant foot" deformation and failure be solved.

Every earthquake comprises horizontal and vertical shocks. The contents of a tank exert a suddenly increased force outwardly on the side wall thereof when they are accelerated upwardly due to the upward acceleration of the earth beneath the tank. This dynamically applied force, which is especially significant for moderate and more violent earthquakes, operates independently of, but cumulatively with, other forces exerted dynamically on the wall due to horizontal acceleration of the tank and statically, by the contents of the tank, due to gravity. In a liquid-containing elastic tank a single vertically applied load will create a deformation which is proportional to the density of the liquid, the height of the liquid, the geometry of the tank and the ratio of the vertical acceleration to the gravitational acceleration multiplied by a dynamic amplification factor of two (2). It will be appreciated that the maximum combined effect of the loads on the elastic tank is exerted at the bottom of the wall of the tank. However, since the bottom of the side wall of the tank is connected to the bottom of the tank and is considered to be hinged thereto, the location of maximum combined stresses on the side wall under earthquake loading conditions does not occur there, but rather at a certain height above the bottom of the tank. This location is a function of the radius of the tank, the thickness of the wall of the tank and the properties of the materials of which the tank wall is constructed.

A further aspect of my discovery relates to a tank having a wall which is tapered from thickest at its base to thinnest at its top, a common configuration for tanks as will be understood by those skilled in the art. The natural frequency of radial vibration (hereinafter radial pulsation) of this tapered wall is substantially constant along the entire height of the wall. This is not the case with a wall which has a uniform wall thickness throughout its height. The influence of vertical acceleration on the behavior of an elastic tank during an earthquake comprising numerous random vertical shocks is such that the tapered wall is highly susceptible to resonating with the forced vertical vibration of the ground, i.e., the tapered wall bulges outwardly at the same time an upward vertical load is applied to the tank. All elastic bodies are subject to this resonance phenomenon under earthquake conditions. The force acting outwardly at a location of maximum combined stresses is multiplied. For moderate and more violent earthquakes the loading conditions of the wall due to vertical vibration of the ground alone are multiplied by a dynamic amplification factor of two or more; the loading conditions of the wall due to said vertical vibration are greater by a factor of two or more than the load applied to the tank wall statically. These dynamically applied loadings exerted on a tank by earthquake shocks can be calculated from data derived from response spectra which have been developed by seismologists for earthquakes characteristic of various geographic areas. An extraordinary force is exerted on the wall causing total failure. Due to the elasticity of steel tank walls, the foregoing phenomenon is particularly evident in steel tanks.

Heretofore, those skilled in the art have not recognized the foregoing phenomena. For example, instead of being located in the lower part of the tank wall, some stiffeners have often been placed around the wall at the top of and various other locations on the tank to counteract wind deformation. However, these are merely rigidizing elements which are not specially adapted to and do not counteract "elephant foot" deformation or failure at the location of maximum combined stresses.

It is, therefore, a primary object of my invention to improve the integrity of liquid-containing tanks under earthquake conditions.

It is also an object of my invention to reduce the tendency for the side walls of such tanks to demonstrate "elephant foot" deformation, i.e., to bulge in the lower parts thereof.

It is another related object of my invention to reduce the tendency for the side walls of such tanks to buckle or fail and to improve the safety of such tanks.

It is a further and related object of my invention to provide new tanks resistant to "elephant foot" deformation and/or failure which are conveniently and economically constructed and to improve the resistance of existing tanks to "elephant foot" deformation and/or failure by an inexpensive and convenient modification.

These and other objects, aspects and advantages of my invention will become more readily apparent from the following detailed description.

In its broadest embodiment, my invention is in a tank adapted to withstand a force acting upon a side wall thereof under earthquake conditions. The tank includes a side wall and reinforcing means surrounding the wall and positioned to band said wall in a stripe configuration. The tank wall is banded by the reinforcing means at a point of maximum combined stresses during earthquake conditions and its ability to counteract the outwardly-directed forces discussed above is thereby increased.

The reinforcing means is, desirably, a cable or group of cables but may be plates, rods, other shapes and/or a band (wall) of cast-in-place, prestressed concrete. The reinforcing means surround the tank at a lower part thereof and at a location of maximum combined stresses resulting from gravitational, horizontal and vertical accelerations under earthquake conditions.

The side wall of the tank may be constructed of suitable material, such as concrete, e.g. cast-in-place concrete or concrete panels, or steel, e.g. steel plates. The wall may be prestressed or nonprestressed or reinforced. The invention is most suitably adapted for use, however, in connection with steel tanks.

My invention also applies to a tank having a side wall tapered (whether continuously or discontinuously) from a maximum thickness at its base to a minimum thickness at its top. The banding of such a tapered wall with one or a plurality of reinforcing means serves to locally increase the effective thickness of the wall. This is also true if the reinforcing means contacts the wall through an element interposed between the reinforcing means and the wall. A change in thickness at one location causes a change in the frequency of radial pulsation at that location because the frequency of radial pulsation of the wall (at any point) is proportional to its thickness. Therefore, my invention is also in a tank including a tapered side wall, said wall being surrounded by reinforcing means positioned to band the wall in a stripe configuration. The reinforcing means, typically cables, contacts the wall or an element abutting the wall. Such reinforcement causes the wall to pulsate radially with different frequencies at different locations with the result that the frequency of the upward vertical accelerations of the tank due to earthquake will not be in phase with the radial pulsation of the entire wall, and the resonance total failure phenomenon described previously is prevented.

Preferably, the tank wall is surrounded by a plurality of cable reinforcing means. These are positioned, advantageously, in a plurality of groups which band the wall at a plurality of positions. In one cable or plurality of cables is situated at a location of maximum combined stresses resulting from gravitational, horizontal and vertical accelerations under earthquake conditions, then failure due to resonance as well as due to the combined stresses acting at said location is avoided.

Thus, an especially preferred embodiment of my invention is a tank including a side wall tapered from a maximum thickness at its bottom to a minimum thickness at its top, wherein a first cable or group of cables surrounds the side wall and is positioned to band the wall in a stripe configuration at the location of maximum combined stresses resulting from gravitational, horizontal and vertical accelerations under earthquake conditions and at least one additional cable or group of cables surrounds the wall and is positioned in a stripe configuration at another location, each of the cables or groups of cables contacting the wall or an element abutting the wall.

My invention also relates to methods for increasing the resistance to bulging or failure of a side wall of a tank for containing a liquid, which comprises surrounding said side wall with reinforcing means and positioning said means to band the wall in a stripe configuration at a location of maximum combined stresses resulting from gravitational, horizontal and vertical accelerations under earthquake conditions. A tank having a side wall which tapers from a maximum thickness at its base to a minimum thickness at its top may be protected with reinforcing means by positioning said means so as to band the wall in a stripe configuration, each of said means contacting the wall or an element abutting the wall. A preferred embodiment is a method comprising surrounding the above-described tapered side wall with a first cable or group of cables positioned to band the wall in a stripe configuration at a location of maximum combined stresses and with at least a second cable or group of cables positioned to band the wall at another location, each of said cables or groups of cables contacting the wall or an element abutting the wall.

Figure 1:
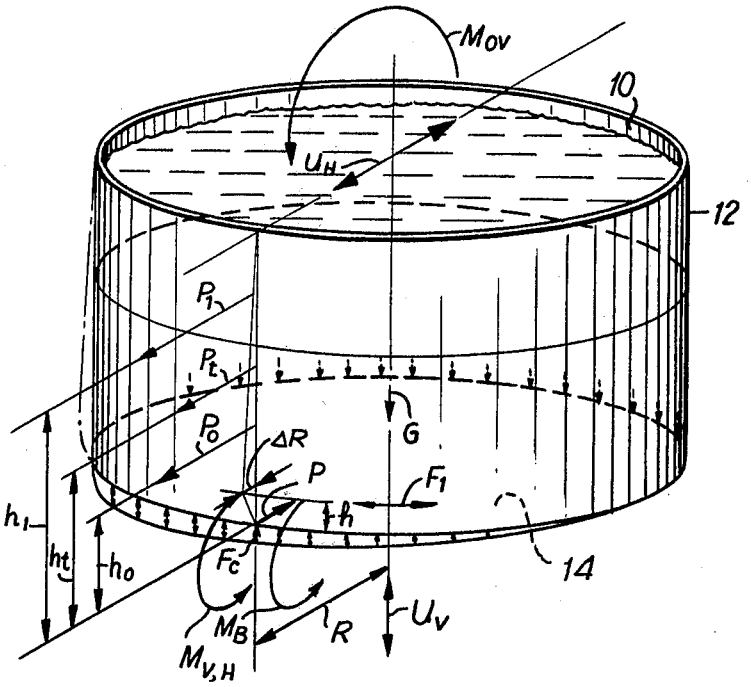
FIG. 1 is a view of a typical tank and forces exerted thereon under earthquake conditions.

In FIG. 1 reference numeral 10 identifies a tank of radius R having side wall 12 and floor 14. The resultant forces on the tank due to gravity and due to vertical and horizontal accelerations caused by earthquake conditions are shown. The gravitational acceleration from the mass of the tank and its contents is identified by G, the vertical acceleration by $U_v$ and the horizontal acceleration by $U_h$. The gravitational acceleration causes the contents of the tank to exert pressure on the side wall 12 and to generate a tensile force $F_1$ in wall 12. The side wall 12 is, at its base, fixed to and restrained by the floor of the tank. A restraining force P is exerted on the wall which, therefore, is subject to bending moment $M_B$ at the base and exhibits radial deflection $\Delta R$. The overturning moment $M_{ov}$ due to horizontal acceleration $U_h$ is the resultant moment created by forces $P_o$ (exerted by the mass of the lower portion of the tank contents), $P_t$ (exerted by the mass of the tank itself) and $P_1$ (exerted by the oscillating upper portion of the liquid) acting on the arms $h_o$, $h_t$ and $h_l$, respectively. Compressive force $F_c$, caused by overturning movement $M_{ov}$, is one of the forces which contributes to "elephant foot" deformation. Additional significant forces are generated by the vertical acceleration $U_v$. When an elastic tank responds to an earthquake-induced vertical acceleration $U_v$ the force $F_1$ significantly increases causing an increase in $\Delta R$ (greater deformation) and proportionately greater bending moment at the base of the wall. Vertical force $F_c$ and the force of the weight of the wall itself effected by vertical acceleration (acting now on a more deformed wall at its base) create an additional bending moment $M_{V,H}$. The ultimate effect of these loading conditions is that the wall will have a tendency to bulge or fail near its base at an elevation h where the combined stresses are greater than the yield or ultimate stress of the material of which the wall is made.

Figure 2:
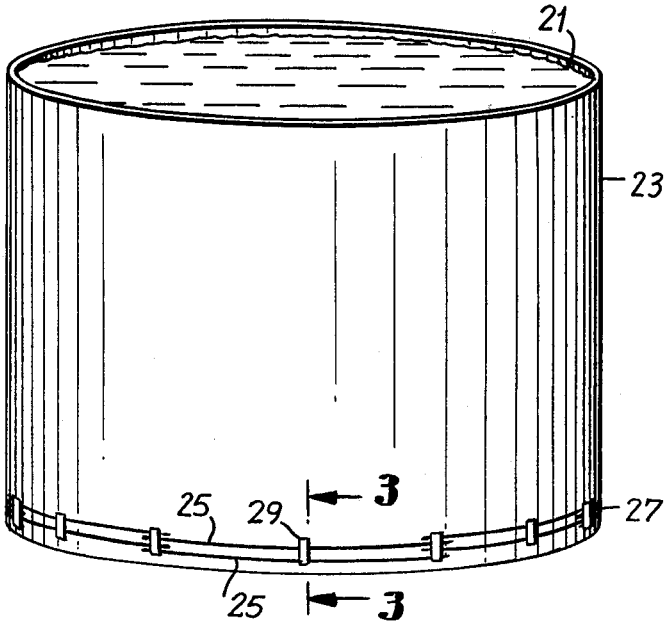
FIG. 2 is a view of a tank according to the invention wherein a plurality of cables bands the outer surface of the side wall of the tank at a location of maximum combined stresses.

In FIG. 2 tank 21 includes side wall 23, said wall being surrounded by a plurality of tensioned cables 25. The cables are arranged in a group and are positioned in a stripe configuration at the location of maximum combined stresses 27 resulting from gravitational, horizontal and vertical accelerations under earthquake loading conditions. The cables are mounted on the wall via cable-securing means 29. The securing means are, for example, clamps and/or wedges adapted for use in securing cables under stress and well-known to those skilled in the art. The securing means, and, therefore, the cables, are attached, for example by welding or clamps, to the wall at intervals around same sufficiently small to ensure that the cables do not slip on the wall during earthquake conditions. Generally, since at least a portion of the securing means is interposed between the tank wall and the cables, causing the latter to be to some extent spaced from the wall, shims or other similar means are inserted in the gaps to ensure uniform contact between wall and cable.

I recognize that the countering of a bulge at a determined location of maximum combined stresses may well give rise to a lesser bulge at another point on the wall, that the countering of that lesser bulge may well give rise to another and even lesser bulge, and so on. It is well within the invention to surround the wall at the locations of such lesser bulges with additional cables or other suitable reinforcing means. The location of these lesser bulges can be calculated from conventional shell theory, for example, Timoshenko, *Theory of Plates and Shells,* McGraw-Hill (1959).

Figure 3:
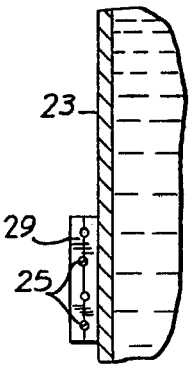
FIG. 3 is a section view taken along lines 3—3 of FIG. 2.

FIG. 3 shows each of cables 25 in the group surrounding the wall 23 at a location of maximum combined stresses 27.

Figure 4:
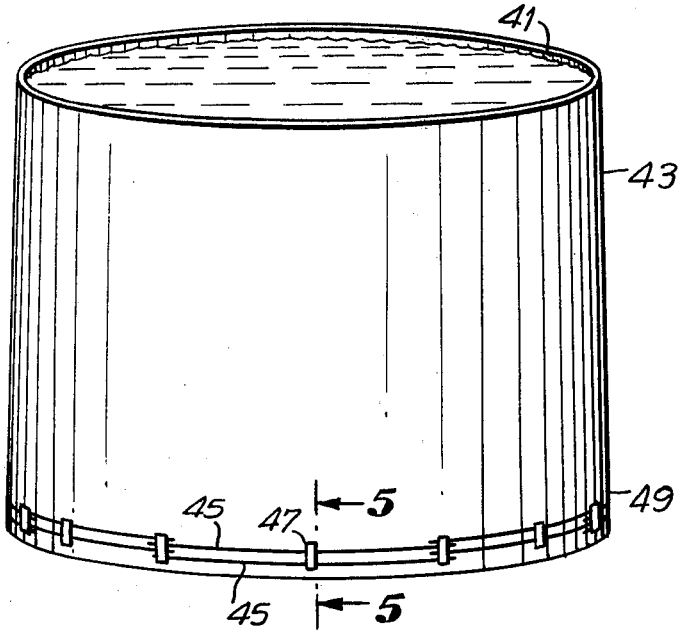
FIG. 4 is a view of a tank according to the invention wherein a plurality of cables bands the outer surface of the side wall of the tank, said side wall having a thickness tapered from a maximum at its base to a minimum at its top.
Figure 5:
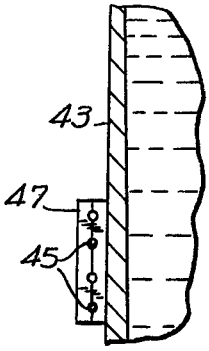
FIG. 5 is a section view taken along line 5—5 of FIG. 4.

FIG. 4 shows a tank 41 having a side wall 43 tapered from a maximum thickness at its base to a minimum thickness at its top (as illustrated in FIG. 5). A plurality of cables 45 surrounds tank wall 43. The cables are arranged in a group abutting the wall and are positioned to band the wall in a stripe configuration, in this case at a location other than that of maximum combined stresses 49 resulting from gravitational, horizontal and vertical accelerations under earthquake conditions. The cables are mounted on the wall by means of cable-securing means 47. The cables may abut the wall directly, or contact spacer elements which themselves abut the wall.

FIG. 5 shows that each of the cables 45 in the group contacts a portion of the securing means 47 which abuts the wall 43. While each cable may contact a spacer element or abut the wall, it is sufficient if at least one cable does so. Moreover, the cables may be arranged so that they are layered on top of one another to form two or more tiers of cables. Such a layered configuration is particularly useful in effecting a local increase in wall thickness and reducing the likelihood of resonance failure of the wall.

Figure 6:
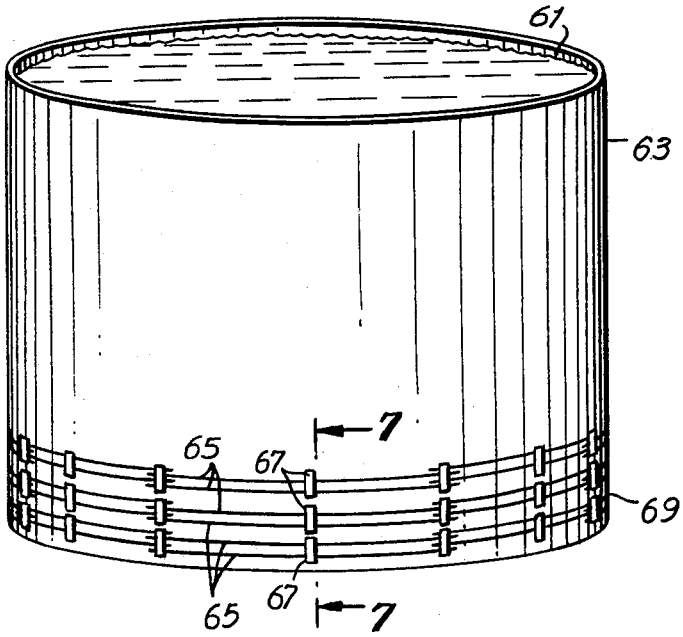
FIG. 6 is a view similar to FIG. 4, wherein the groups of cables are positioned at the location of maximum combined stresses and at two other locations.
Figure 7:
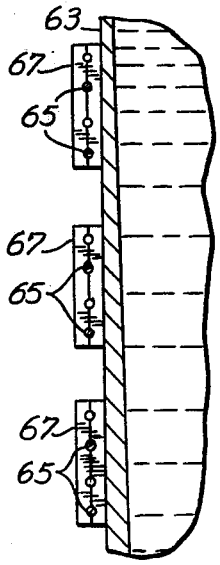
FIG. 7 is a sectional view taken along line 7—7 of FIG. 6.

FIG. 6 shows another more specific embodiment of the invention. Tank 61 includes side wall 63, the wall being tapered from a maximum thickness at its base to a minimum thickness at its top (as shown in FIG. 7). Wall 63 is surrounded by a plurality of cables 65 which are mounted by means of cable-securing means 67. The cables are arranged in groups and each contacts the securing means 67 which abuts the side wall 63. Although in FIG. 7 each of the cables contacts an element which abuts the wall, it is not necessary that this be the case. One or more of the cables may actually abut the wall. Also, a layered configuration may be advantageous as discussed above. The group nearest the bottom of wall 63 is positioned to band the wall in a stripe configuration at a location of maximum combined stresses 69 resulting from gravitational, horizontal and vertical accelerations under earthquake conditions. The other two groups of cables are positioned at other locations on the wall and are spaced from one another to form a three stripe configuration on the wall as shown in FIGS. 6 and 7.

Figure 8:
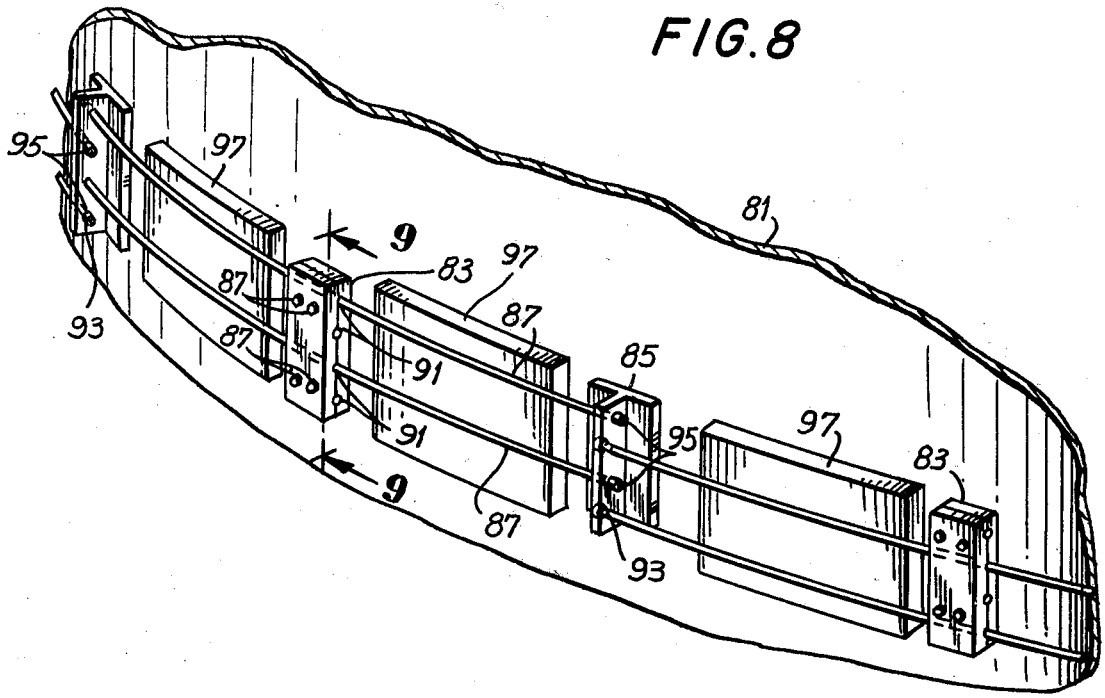
FIG. 8 is a view of a portion of a tank wall wherein a plurality of cables is secured to the wall and shims have been inserted in the gaps between the cables and the wall surface.

FIG. 8 illustrates conventional cable-securing means. Multi-part clamps 83 and T-sections 85 are welded to wall 81. The clamps are held together by bolts 89. The cables 87 pass through grooves 91 in the clamps and holes 93 in the T-sections. The cable ends are secured at the T-section holes by wedges 95. Because portions of the securing means are interposed between the cables and the wall, gaps between the cables and the wall occur. Shims 97 are inserted in the gaps to ensure uniform contact between the wall and cables.

Figure 9:
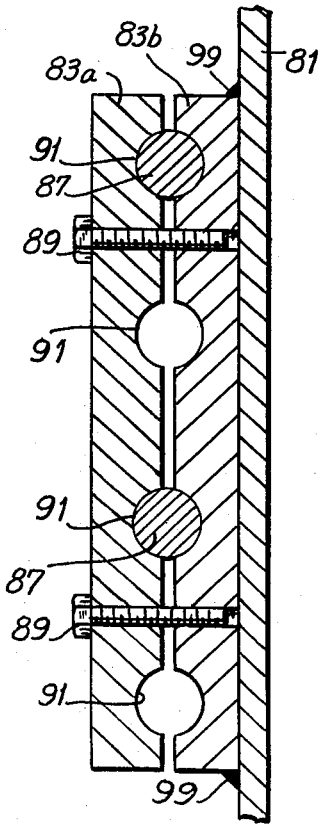
FIG. 9 is a sectional view taken along line 9—9 of FIG. 8.

FIG. 9 illustrates a cross-sectional view of multipart clamp 83. Opposing halves 83*a* and 83*b* have grooves 91 to receive the cables 87. The clamp is equipped with bolts 89 which can be tightened to cause the opposing halves 83*a* and 83*b* to close on the cables 87, thereby securing them. The clamp is attached to the wall 81 by welds 99.

Figure 10:
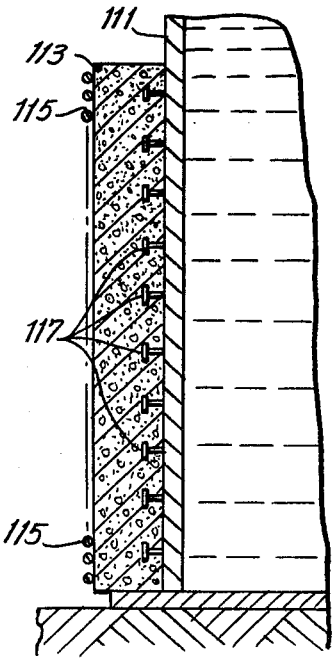
FIG. 10 is a cross-sectional view of a wall surrounded by a band of cast-in-place, prestressed concrete.

FIG. 10 shows alternative reinforcing means, i.e., a band of prestressed concrete 113 surrounding the lower portion of the wall 111. The prestressing is effected via tensioned cables 115 which rest on the surface of the concrete. The cables may be gunited by pneumatic mortar. Of course, the concrete may be prestressed by cables embedded in the concrete. Studs 117 project from the wall into the concrete band to secure it. The concrete band is cast-in-place, generally with a wooden form erected temporarily on the tank wall, and prestressed in a conventional manner. It may be advantageous to use a greater number of cables than usual when employing this reinforcing means inasmuch as both concrete band and wall must be prestressed.

The elevation on the tank wall at which the location of maximum combined stresses occurs may be determined by (1) calculating the moments and forces exerted at individual elevations on the tank wall, (2) calculating for each such elevation the corresponding stress thereat due to each said moment and force and (3) summing the stresses at each said elevation and selecting the elevation at which the combined stresses are a maximum. As illustrated in FIG. 1, these moments and forces which generate stress comprise a hoop or ring force due to gravitational acceleration (generating a hoop stress), a bending moment due to the restraining force exerted on the wall by the floor of the tank (generating a bending stress), a hoop or ring force (increase) due to vertical acceleration (generating additional hoop stress), an additional bending moment due to increased restraining force on the wall due to vertical acceleration (generating additional bending moment), an overturning moment (generating vertical stress in the wall) and a bending moment developed as an effect of vertical force in the wall and the deformation of the wall at its base, i.e., a moment caused by a force acting in the direction of the wall on an arm corresponding to the distance between the wall in its deformed (bulging) state and the wall in its normal state (generating another stress). This last-mentioned bending moment contributes so significantly to the generation of stresses on the wall that it may cause the contribution of the remaining moments and forces to be negligible.

Of course, once it is appreciated that loading conditions on the tank due to all of gravitational, horizontal and vertical accelerations of the tank and its contents under earthquake conditions must be taken into account, the determination of the elevation at which a location of maximum combined stresses occurs may be accomplished using conventional shell theory, such as set forth in Hetenyi, *Beams of Elastic Foundation,* University of Michigan Press; and Timoshenko, *Theory of Plates and Shells;* McGraw-Hill (1959). For example, the foregoing elevation may be determined by (1) calculating for individual elevations on the tank wall, at each of said individual elevations an overturning moment $M_{ov}$ thereat equal to $$F_o h_o + F_l h_l + F_t h_t$$

wherein $F_o$, $F_l$ and $F_t$ are, respectively, the forces exerted by the mass of the lower portion of the tank contents, the mass of the upper portion of the tank contents and the tank itself and $h_o$, $h_l$ and $h_t$ are respectively the distances from said individual elevation at which these forces act;

a moment $M_{V,H}$ thereat equal to $$-\frac{P}{\beta}\ \frac{2\lambda^2}{3\alpha^2-\beta^2}\ e^{-\alpha x}\sin\beta x$$

wherein P is the restraining force on the wall at its base under earthquake conditions; $\lambda$ is a shell constant; $\beta$ and $\alpha$ are equal to $\sqrt{\lambda^2+(N/4EI)}$ and $\sqrt{\lambda^2-(N/4EI)}$, respectively, N being the vertical force in the wall due to overturning moment and the weight of the tank, E being Young's Modulus and I being the moment of intertia of a unit length of the wall; and x is the elevation;

a moment $M_{BX}$ thereat equal to $$\xi M_B$$

wherein $\xi$ is a coefficient which is a function of the elevation and of the geometry of the tank and $M_B$ is the bending moment which is determined by solving the equation $$(P/2\lambda^2 D)-(M_B/2\lambda D)+(pl^3/48\ EI_F)-(M_B l/4\ EI_F)=0$$

wherein P, $\lambda$ and E are as defined above; D is a shell constant; $I_F$ is the moment of inertia of a unit length of the floor of the tank; p is the liquid pressure at the bottom of the tank; and l is $2\sqrt{M_B/p}$;

a moment thereat equal to $$\nu \cdot M_{ov}$$

wherein $\nu$ is the Poisson ratio and $M_{ov}$ is the above-identified overturning moment;

and a force equal to $$(1+\epsilon\frac{U_v}{g})((\gamma\cdot x\cdot r)-\Gamma\sqrt{\frac{r}{t}}P)$$

wherein $U_v$ is the vertical acceleration; g is gravitational acceleration; $\epsilon$ is an earthquake dynamic amplification factor (which may be determined from the above-mentioned response spectra); $\Gamma$ is a coefficient which is a function of the elevation and of the geometry of the tank; $\gamma$ is the density of the liquid, t is the wall thickness; r is the tank radius; and x and P are as defined above; (2) calculating the corresponding stresses by dividing the moments $M_{V,H}$ and $M_{BX}$ by $(t^2 \cdot b)/6$, the overturning moment $M_{ov}$ by $\pi r^2 t$ and each said force by (t·b), wherein t is the wall thickness, r is the radius and b is the unit area for which the stress is calculated and (3) summing the stresses at each elevation and selecting the elevation at which the combines stresses are a maximum.

It is also within the scope of my invention to position the reinforcing means at a location on the tank wall such that the elasticity of the tank wall is preserved (or, in other words, permanent deformation is avoided) while a minimum amount of said reinforcing means is employed. This may be accomplished by calculating a sum of the stresses for individual elevations on the tank wall, including the contribution of the counteracting force of the reinforcing means, and selecting an elevation at which the sum of the stresses is sufficiently low to preserve the elasticity of the wall and the amount of reinforcing means banding the wall is a minimum.

The reinforcing means may be prestressed, in particular the reinforcing cables may be tensioned, or not tensioned. When the cables are tensioned, the tension should not be so high that the tank wall collapses or buckles inwardly when the tank is empty.

The prestressing may be accomplished by conventional methods. For example, tensioning may be accomplished by means of a conventional hand jack or hydraulic jack, or by other means familiar to those skilled in the art. With a hand jack, for instance, a cable of 0.5 inches in diameter can be tensioned by applying a force up to about 29,000 pounds and a cable of 0.6 inches in diameter can be tensioned by applying up to about 40,000 pounds. Desirably each cable is tensioned to about 190,000 psi.

When the cables are tensioned around the tank wall it is often advantageous to have between the wall and the cables one or more rigidizing elements, such as a channel, to enhance the resistance of the empty tank to inward buckling. The elements may be arranged in the path of the cables around the wall. The elements may be sectioned and spaced from one another and attached to the wall via bolts, clamps, welding, etc. Advantageously, the elements are bolted or clamped in place on the wall temporarily and subsequent to prestressing welded permanently to the wall. In this manner the wall, and not just the elements, is prestressed because these elements are not fixed to the wall and are at sufficiently small intervals to prevent the wall of an empty tank from buckling inwardly from the force exerted by the tensioned cables. The cables can be attached to the wall through an element via the cable-securing means previously described, for example in FIGS. 8 and 9. If the securing means causes a gap to occur between the cable and the element, a shim or other similar means may be inserted as also previously described.

In addition, if the elements are sectioned, spaced and attached as described above, when the tank is empty the wall may deform inwardly, under the tension of the cable, until the elements contact one another and form a continuous rigidizing element which resists inward buckling of the wall.

Where the cables are not pre-tensioned, they become stressed only under earthquake conditions. They then resist tank deformation as discussed above. When the cables are initially nonstressed, they may also be held in position on the outer surface of the tank by conventional means, for example, by a series of support hooks.

The invention is particularly advantageous in that already-existing tanks can be protected by surrounding and banding the side walls thereof with reinforcing cables, an undertaking well within the skill of the art.

Although tanks can be strengthened to some extent by welding plates or shapes, such as channels, to the tank wall at the point of maximum combined stresses these forms have limited strengths. Also, welding costs are relatively high. It has been found that banding with one or more cables is particularly advantageous due to the extremely high ultimate strength of cables in comparison with steel plates. Banding of the tank with cables is also accomplished more economically than by welding plates to the tank wall.

It will, of course, be understood that various details of construction may be modified without departing from the principles of the invention.

What is claimed is:

1. A tank for containing a liquid adapted to withstand a force acting upon a side wall thereof under earthquake conditions, including a side wall and a reinforcing means surrounding the wall and banding it in a stripe configuration at a location of maximum combined stresses resulting from gravitational, horizontal and vertical accelerations of the tank and its contents under earthquake conditions.

2. A tank as defined in claim 1, wherein the reinforcing means bands the wall at an elevation determined by (1) calculating for individual elevations on the wall the respective moments and forces exerted thereat, (2) calculating from these moments and forces the corresponding stresses at each elevation and (3) summing the stresses for each elevation and selecting the elevation at which the stresses are a maximum.

3. A tank as defined in claim 2, including a floor and wherein the reinforcing means bands the wall at an elevation on the tank wall determined by (1) calculating for individual elevations on the tank wall, at each of said individual elevations an overturning moment $M_{ov}$ thereat equal to $$F_o h_o + F_l h_l + F_t h_t$$

wherein $F_o$, $F_l$ and $F_t$ are, respectively, the forces exerted by the mass of the lower portion of the tank contents, the mass of the upper portion of the tank contents and the mass of the tank itself and $h_o$, $h_l$ and $h_t$ are respectively the distances from said individual elevation at which these forces act;

a moment $M_{V,H}$ thereat equal to $$-\frac{P}{\beta}\ \frac{2\lambda^2}{3\alpha^2-\beta^2}\ e^{-\alpha x}\sin\beta x$$

wherein P is the restraining force on the wall at its base under earthquake conditions; $\lambda$ is a shell constant; $\beta$ and $\alpha$ are equal to $\sqrt{\lambda^2+(N/4EI)}$ and $\sqrt{\lambda^2-(N/4EI)}$, respectively, N being the vertical force in the wall due to overturning moment and the weight of the tank, E being Young's Modulus and I being the moment of inertia of a unit length of the wall; and x is the elevation;

a moment $M_{BX}$ thereat equal to $$\xi M_B$$

wherein $\xi$ is a coefficient which is a function of the elevation and of the geometry of the tank and $M_B$ is the bending moment which is determined by solving the equation $$(P/2\lambda^2 D)-(M_B 2\lambda D)+(pl^3/48\ EI_F)-(M_B l/4\ EI_F)=0$$

wherein P, λ and E are as defined above; D is a shell constant; $I_F$ is the moment of inertia of a unit length of the floor of the tank; p is the liquid pressure at the bottom of the tank; and l is equal to $2\sqrt{M_B/p}$;

a moment thereat equal to $$\nu \cdot M_{ov}$$

wherein $\nu$ is the Poisson ratio and $M_{ov}$ is the above-identified overturning moment;

and a force equal to $$(1+\epsilon\frac{U_v}{g})((\gamma\cdot x\cdot r)-\Gamma\sqrt{\frac{r}{t}}P)$$

wherein $U_v$ is the vertical acceleration; g is gravitational acceleration; $\epsilon$ is an earthquake dynamic amplification factor; Γ is a coefficient which is a function of the elevation and of the geometry of the tank; γ is the density of the liquid; t is the wall thickness; r is the tank radius; and x and P are as defined above; (2) calculating the corresponding stress by dividing the moments $M_{V,H}$ and $M_{BX}$ by $(t^2 \cdot b)/6$, the overturning moment $M_{ov}$ by $\pi r^2 t$ and each said force by (t·b), wherein t is the wall thickness, r is the radius and b is the unit area for which the stress is calculated and (3) summing the stresses at each elevation and selecting the elevation at which the combined stresses are a maximum.

4. A tank as defined in claim 1, 2 or 3, wherein the reinforcing means is not tensioned.

5. A tank as defined in claim 1, 2 or 3, wherein the reinforcing means is prestressed.

6. A tank as defined in claim 1, 2 or 3, wherein the reinforcing means is a discrete cable or a plurality of discrete cables in a group.

7. A tank as defined in claim 1, wherein the reinforcing means bands the wall at a location of maximum combined stresses, one of said stresses resulting from loading due to the deformation of the tank at its base.

8. An elastic tank for containing a liquid adapted to withstand a force acting upon a side wall thereof under earthquake conditions, including a side wall and a reinforcing means surrounding the wall and banding it in a stripe configuration at a location where a minimum amount of said means causes the sum of the stresses due to gravitational, horizontal and vertical accelerations of the tank and its contents and the counteracting force of said reinforcing means to be sufficiently low that the elasticity of the tank is preserved.

9. A tank for containing a liquid adapted to withstand a force acting upon a side wall thereof under earthquake conditions, including a side wall tapered from a maximum thickness at its base to minimum thickness at its top and reinforcing means surrounding the wall and banding it in a stripe configuration, said reinforcing means contacting said wall or an element abutting said wall, such that each portion of the wall contacting said reinforcing means, or abutting said element contacting said reinforcing means, pulsates radially with a different frequency than each portion of the wall not contacting said reinforcing means or abutting said element, thereby preventing radial pulsation of the entire wall in phase with vertical accelerations of the tank during earthquake conditions.

10. A tank as defined in claim 9, wherein said wall is steel.

11. A tank as defined in claim 9, wherein the reinforcing means is not tensioned.

12. A tank as defined in claim 9, wherein the reinforcing means is prestressed.

13. A tank as defined in claim 9, wherein the wall is surrounded by a plurality of cables arranged in a plurality of groups each banding the wall in a stripe configuration and each of said groups contacting the wall or an element abutting the wall.

14. A cylindrical steel tank for containing a liquid adapted to withstand a force acting upon a side wall thereof under earthquake conditions, including a cylindrical side wall tapered from a maximum thickness at its base to a minimum thickness at its top, a first cable or group of cables surrounding the wall and banding it in a stripe configuration at a location of maximum combined stresses resulting from gravitational, horizontal and vertical accelerations of the tank and its contents under earthquake conditions and at least one other cable or group of cables surrounding the wall and banding it in a stripe configuration at at least one other location, each of said cables or groups thereof contacting said wall or an element abutting said wall, such that each portion of the wall contacting one of the cables or groups of cables, or abutting said element contacting one of the cables or groups of cables, pulsates radially with a different frequency than each portion of the wall not contacting any of the cables or groups of cables or abutting any said element, thereby preventing radial pulsation of the entire wall in phase with vertical accelerations of the tank during earthquake conditions.

15. A tank as defined in claim 14, wherein the first cable or group of cables bands the wall at an elevation determined by (1) calculating for individual elevations on the wall the respective moments and forces exerted thereat, (2) calculating from these moments and forces the corresponding stresses at each elevation and (3) summing the stresses for each elevation and selecting the elevation at which the stresses are a maximum.

16. A tank as defined in claim 15, including a floor and wherein a first cable or group of cables bands the wall at an elevation on the tank wall determined by (1) calculating for individual elevations on the tank wall, at each of said individual elevations an overturning moment $M_{ov}$ thereat equal to $$F_o h_o + F_l h_l + F_t h_t$$

wherein $F_o$, $F_l$ and $F_t$ are, respectively, the forces exerted by the mass of the lower portion of the tank contents, the mass of the upper portion of the tank contents and the mass of the tank itself and $h_o$, $h_l$ and $h_t$ are respectively the distances from said individual elevation at which these forces act;

a moment $M_{V,H}$ thereat equal to $$-\frac{P}{\beta}\ \frac{2\lambda^2}{3\alpha^2-\beta^2}\ e^{-\alpha x}\sin\beta x$$

wherein P is the restraining force on the wall at its base under earthquake conditions; $\lambda$ is a shell constant; $\beta$ and $\alpha$ are equal to $\sqrt{\lambda 2+(N/4EI)}$ and $\sqrt{\lambda 2-(N/4EI)}$, respectively, N being the vertical force in the wall due to overturning moment and the weight of the tank, E being Young's Modulus and I being the moment of inertia of a unit length of the wall; and x is the elevation;

a moment $M_{BX}$ thereat equal to $$\xi M_B$$

wherein $\xi$ is a coefficient which is a function of the elevation and of the geometry of the tank and $M_B$ is the bending moment which is determined by solving the equation $$(P/2\lambda^2 D)-(M_B/2\lambda D)+(pl^3/48\ EI_F)-(M_B l/4\ EI_F)=0$$

wherein P, $\lambda$ and E are as defined above; D is a shell constant; $I_F$ is the moment of inertia of a unit length of the floor of the tank; p is the liquid pressure at the bottom of the tank; and l is equal to $2\sqrt{M_B/p}$;

a moment thereat equal to $$\nu \cdot M_{ov}$$

wherein $\nu$ is the Poisson ratio and $M_{ov}$ is the above-identified overturning moment;

and a force equal to $$(1+\epsilon\frac{U_v}{g})((\gamma\cdot x\cdot r)-\Gamma\sqrt{\frac{r}{t}}P)$$

wherein $U_v$ is the vertical acceleration; g is gravitational acceleration; $\epsilon$ is an earthquake dynamic amplification factor; $\Gamma$ is a coefficient which is a function of the elevation and of the geometry of the tank; $\gamma$ is the density of the liquid; t is the wall thickness; r is the tank radius; and x and P are as defined above; (2) calculating the corresponding stress by dividing the moments $M_{V,H}$ and $M_{BX}$ by $(t^2 \cdot b)/6$, the overturning moment $M_{ov}$ by $\pi\ r^2 t$ and each said force by $(t \cdot b)$, wherein t is the wall thickness, r is the radius and b is the unit area for which the stress is calculated and (3) summing the stresses at each elevation and selecting the elevation at which the combined stresses are a maximum.

17. A tank as defined in claim 14, 15 or 16, wherein each cable is not tensioned.

18. A tank as defined in claim 14, 15 or 16, wherein each cable is tensioned.

19. A tank as defined in claim 14, 15 or 16, wherein the wall is surrounded by a plurality of cables arranged in a plurality of groups banding the wall in a stripe configuration, each of said groups contacting said wall or an element abutting said wall.

20. A tank as defined in claim 14, wherein the first cable or group of cables bands the wall at a location of maximum combined stresses, one of said stresses resulting from loading due to the deformation of the tank at its base.

21. An elastic cylindrical steel tank for containing a liquid adapted to withstand a force acting upon a side wall thereof under earthquake conditions, including a cylindrical side wall tapered from a maximum thickness at its base to a minimum thickness at its top, a first cable or group of cables surrounding the wall and banding it in a stripe configuration at a location where a minimum amount of said cable causes the sum of the stresses due to gravitational, horizontal and vertical accelerations of the tank and its contents and the counteracting force of said cable under earthquake conditions to be sufficiently low that the elasticity of the tank is preserved, and at least one other cable or group of cables surrounding the wall and banding it in a stripe configuration at at least one other location, each of said cables or groups thereof contacting said wall or an element abutting said wall, such that each portion of the wall contacting one of the cables or groups of cables, or abutting said element contacting one of the cables or groups of cables, pulsates radially with a different frequency than each portion of the wall not contacting any of the cables or groups of cables or abutting any said element, thereby preventing radial pulsation of the entire wall in phase with vertical accelerations of the tank during earthquake conditions.

22. A method of increasing the resistance to bulging and failure of a side wall of a tank for containing a liquid under earthquake conditions, which comprises surrounding said wall with reinforcing means positioned to band the wall in a stripe configuration at a location of maximum combined stresses resulting from gravitational, horizontal and vertical accelerations of the tank and its contents under earthquake conditions.

23. A method as defined in claim 22, wherein the reinforcing means is positioned to band the wall at an elevation determined by (1) calculating for individual elevations on the wall the respective moments and forces exerted thereat, (2) calculating from these moments and forces the corresponding stresses at each elevation and (3) summing the stresses for each elevation and selecting the elevation at which the stresses are a maximum.

24. A method as defined in claim 23, for reinforcing a tank including a floor and wherein the reinforcing means is positioned to band the wall at an elevation on the tank wall determined by (1) calculating for individual elevations on the tank wall, at each of said individual elevations an overturning moment $M_{ov}$ thereat equal to $$F_o h_o + F_l h_l + F_t h_t$$

wherein $F_o$, $F_l$ and $F_t$ are, respectively, the forces exerted by the mass of the lower portion of the tank contents, the mass of the upper portion of the tank contents and the mass of the tank itself and $h_o$, $h_l$ and $h_t$ are respectively the distances from said individual elevation at which these forces act;

a moment $M_{V,H}$ thereat equal to $$-\frac{P}{\beta}\ \frac{2\lambda^2}{3\alpha^2-\beta^2}\ e^{-\alpha x}\sin\beta x$$

wherein P is the restraining force on the wall at its base under earthquake conditions; $\lambda$ is a shell constant; $\beta$ and $\alpha$ are equal to $\sqrt{\lambda^2+(N/4EI)}$ and $\sqrt{\lambda^2-(N/4EI)}$, respectively, N being the vertical force in the wall due to overturning moment and the weight of the tank, E being Young's Modulus and I being the moment of inertia of a unit length of the wall; and x is the elevation;

a moment $M_{BX}$ thereat equal to $$\xi M_B$$

wherein $\xi$ is a coefficient which is a function of the elevation and of the geometry of the tank and $M_B$ is the bending moment which is determined by solving the equation $$(P/2\lambda^2 D)-(M_B/2\lambda D)+(pl^3/48 EI_F)-(M_B l/4EI_F)=0$$

wherein P, $\lambda$ and E are as defined above; D is a shell constant; $I_F$ is the moment of inertia of a unit length of the floor of the tank; p is the liquid pressure at the bottom of the tank; and l is equal to $2\sqrt{M_B/p}$;

a moment thereat equal to $$\nu \cdot M_{ov}$$

wherein $\nu$ is the Poisson ratio and $M_{ov}$ is the above-identified overturning moment;

and a force equal to $$(1+\epsilon\frac{U_v}{g})((\gamma\cdot x\cdot r)-\Gamma\sqrt{\frac{r}{t}}P)$$

wherein $U_v$ is the vertical acceleration; g is gravitational acceleration; $\epsilon$ is an earthquake dynamic amplification factor; $\Gamma$ is a coefficient which is a function of the elevation and of the geometry of the tank; $\gamma$ is the density of the liquid; t is the wall thickness; r is the tank radius; and x and P are as defined above; (2) calculating the corresponding stress by dividing the moments $M_{V,H}$ and $M_{BX}$ by $(t^2 \cdot b/6)$, the overturning moment $M_{ov}$ by $\pi r^2 t$ and each said force by $(t \cdot b)$, wherein t is the wall thickness, r is the radius and b is the unit area for which the stress is calculated and (3) summing the stresses at each elevation and selecting the elevation at which the combined stresses are a maximum.

25. A method as defined in claim 22, 23 or 24, wherein the reinforcing means is not tensioned.

26. A method as defined in claim 22, 23 or 24, wherein the reinforcing means is prestressed.

27. A method as defined in claim 22, 23 or 24, wherein the wall is surrounded by a plurality of reinforcing cables arranged in at least one group and positioned to band the wall in a stripe configuration.

28. A method as defined in claim 22, wherein the reinforcing means is positioned to band the wall at said location of maximum combined stresses, one of said stresses resulting from loading due to the deformation of the tank at its base.

29. A method for increasing the resistance to bulging and failure of a side wall of an elastic tank for containing a liquid under earthquake conditions, which comprises surrounding said wall with a reinforcing means positioned to band the wall in a stripe configuration at a location where a minimum amount of said means causes the sum of the stresses due to gravitational, horizontal and vertical accelerations of the tank and its contents and the counteracting force of said reinforcing means to be sufficiently low that the elasticity of the tank is preserved.

30. A method for increasing the resistance to bulging and failure under earthquake conditions of a cylindrical side wall of a tank for containing a liquid, said wall being tapered from a maximum thickness at its base to a minimum thickness at its top, which comprises surrounding said wall with reinforcing means and positioning said reinforcing means to band the wall in a stripe configuration, said means contacting the wall or an element abutting the wall, such that each portion of the wall contacting said reinforcing means, or abutting said element contacting said reinforcing means, pulsates radially with a different frequency than each portion of the wall not contacting said reinforcing means or abutting said element, thereby preventing radial pulsation of the entire wall in phase with vertical accelerations of the tank during earthquake conditions.

31. A method as defined in claim 30, wherein said wall is steel.

32. A method as defined in claim 30, wherein the reinforcing means is not tensioned.

33. A method as defined in claim 30, wherein the reinforcing means is prestressed.

34. A method as defined in claim 30, wherein the wall is surrounded by a plurality of cables arranged in a plurality of groups each group banding the wall in a stripe configuration and each of said groups contacting the wall or an element abutting the wall.

35. A method of increasing the resistance to bulging and failure of a cylindrical side wall of a tank for containing a liquid under earthquake conditions, said wall being tapered from a maximum thickness at its base to a minimum thickness at its top, which comprises surrounding the wall with a first cable or group of cables positioned to band the wall in a stripe configuration at a location of maximum combined stresses resulting from gravitational, horizontal and vertical accelerations of the tank and its contents under earthquake conditions, and surrounding said wall with at least one other cable or group of cables positioned to band the wall in a stripe configuration at at least one other location, each of said cables or groups contacting the wall or an alement abutting the wall, such that each portion of the wall contacting one of the cables or groups of cables, or abutting said element contacting one of the cables or groups of cables, pulsates radially with a different frequency than each portion of the wall not contacting any of the cables or groups of cables or abutting any said element, thereby preventing radial pulsation of the entire wall in phase with vertical accelerations of the tank during earthquake conditions.

36. A method as defined in claim 35, wherein the first cable or group of cables is positioned to band the wall at an elevation determined by (1) calculating for individual elevations on the wall the respective moments and forces exerted thereat, (2) calculating from these moments and forces the corresponding stresses at each elevation and (3) summing the stresses for each elevation and selecting the elevation at which the stresses are a maximum.

37. A method as defined in claim 36, for reinforcing a tank including a floor and wherein the reinforcing means is positioned to band the wall at an elevation on the tank wall determined by (1) calculating for individual elevations on the tank wall, at each of said individual elevations an overturning moment $M_{ov}$ thereat equal to $$F_o h_o + F_l h_l + F_t h_t$$

wherein $F_o$, $F_l$ are, respectively, the forces exerted by the mass of the lower portion of the tank contents, the mass of the upper portion of the tank contents and the mass of the tank itself and $h_o$, $h_l$ and $h_t$ are respectively the distances from said individual elevation at which these forces act;

a moment $M_{V,H}$ thereat equal to $$-\frac{P}{\beta}\ \frac{2\lambda^2}{3\alpha^2-\beta^2}\ e^{-\alpha x}\sin\beta x$$

wherein P is the restraining force on the wall at its base under earthquake conditions; $\lambda$ is a shell constant; $\beta$ and $\alpha$ are equal to $\sqrt{\lambda^2+(N/4EI)}$ and $\sqrt{\lambda^2-(N/4EI)}$, respectively, N being the vertical force in the wall due to overturning moment and the weight of the tank, E being Young's Modulus and I being the moment of inertia of a unit length of the wall; and x is the elevation;

a moment $M_{BX}$ thereat equal to $$\xi M_B$$

wherein $\xi$ is a coefficient which is a function of the elevation and of the geometry of the tank and $M_B$ is the bending moment which is determined by solving the equation $$(P/2\lambda^2 D)-(M_B/2\lambda D)+(pl^3/48\ EI_F)-(M_B l/4\ EI_F)=0$$

wherein P, $\lambda$ and E are as defined above, D is a shell constant; $I_F$ is the moment of inertia of a unit length of the floor of the tank; p is the liquid pressure at the bottom of the tank; and $l$ is equal to $2\sqrt{M_B/p}$;

a moment thereat equal to $$\nu \cdot M_{ov}$$

wherein $\nu$ is the Poisson ratio and $M_{ov}$ is the above-identified overturning moment;

and a force equal to $$(1+\epsilon\frac{U_v}{g})((\gamma\cdot x\cdot r)-\Gamma\sqrt{\frac{r}{t}}P)$$

wherein $U_v$ is the vertical acceleration; g is gravitational acceleration; $\epsilon$ is an earthquake dynamic amplification factor; $\Gamma$ is a coefficient which is a function of the elevation and of the geometry of the tank; $\gamma$ is the density of the liquid; t is the wall thickness; r is the tank radius; and x and P are as defined above; (2) calculating the corresponding stress by dividing the moments $M_{V,H}$ and $M_{BX}$ by $(t^2 \cdot b/6)$, the overturning moment $M_{ov}$ by $\pi r^2 t$ and each said force by $(t \cdot b)$, wherein t is the wall thickness, r is the radius and b is the unit area for which the stress is calculated and (3) summing the stresses at each elevation and selecting the elevation at which the combined stresses are a maximum.

38. A method as defined in claim 35, 36 or 37, wherein the cable is not tensioned.

39. A method as defined in claim 35, 36 or 37, wherein the cable is tensioned.

40. A method as defined in claim 35, 36 or 37, wherein a plurality of cables arranged in a plurality of groups are positioned to band the wall in a stripe configuration, each of said groups contacting said wall or an element abutting said wall.

41. A method as defined in claim 35, wherein the reinforcing means is positioned to band the wall at said location of maximum combined stresses, one of said stresses resulting from loading due to the deformation of the tank at its base.

42. A method for increasing the resistance to bulging and failure of a side wall of an elastic tank for containing a liquid under earthquake conditions, which comprises surrounding said wall with a first cable or group of cables positioned to band the wall in a stripe configuration at a location where a minimum amount of said cable causes the sum of the stresses due to gravitational, horizontal and vertical accelerations of the tank and its contents and the counteracting force of said cable under earthquake conditions to be sufficiently low that the elasticity of the tank is preserved, and at least one other cable or group of cables positioned to band the wall in a stripe configuration at at least one other location, each of said cables or groups thereof contacting said wall or an element abutting said wall, such that each portion of the wall contacting one of the cables or groups of cables, or abutting said element contacting one of the cables or groups of cables, pulsates radially with a different frequency than each portion of the wall not contacting any of the cables or groups of cables or abutting any said element, thereby preventing radial pulsation of the entire wall in phase with vertical accelerations of the tank during earthquake conditions.

* * * * *